US005904601A

United States Patent [19]

Palokangas et al.

[11] Patent Number: 5,904,601

[45] Date of Patent: May 18, 1999

[54] PROPULSION UNIT

[75] Inventors: Martti Palokangas, Espoo; Rurik Nyman, Vantaa; Kari Laukia, Espoo, all of Finland

[73] Assignee: Abb Azipod Oy, Helsinki, Finland

[21] Appl. No.: 09/109,557

[22] Filed: Jul. 2, 1998

[30] Foreign Application Priority Data

Jul. 4, 1997 [FI] Finland ..... 972855

[51] Int. Cl.[6] ..... B63H 5/12

[52] U.S. Cl. ..... 440/54

[58] Field of Search ..... 114/151; 440/38, 440/53, 54, 67

[56] References Cited

U.S. PATENT DOCUMENTS

| | | | |
|---|---|---|---|
| 2,987,027 | 6/1961 | Wanzer | 440/54 |
| 4,036,163 | 7/1977 | Pehrsson | 114/151 |
| 4,075,971 | 2/1978 | Reginensi et al. . | |
| 4,573,929 | 3/1986 | Savikurki et al. . | |

FOREIGN PATENT DOCUMENTS 960319 7/1997 Finland .

*Primary Examiner*—Ed. L. Swinehart
*Attorney, Agent, or Firm*—Smith-Hill and Bedell

[57] ABSTRACT

A ship propulsion unit includes a propeller pod (14) provided with a propulsion propeller (15) and a turnable shaft (2) attached to the propulsion pod. The turnable shaft is journalled in the hull (1) of the ship by a rotation bearing (4) mounted in the hull and a rotation mechanism (3) mounted in the hull is coupled to the turnable shaft for turning the shaft. A seal (5) is provided in an annular space (9) between the turnable shaft and the hull for protecting the rotation bearing and the rotation mechanism. The propulsion unit is releasably attached to the hull by an attachment mechanism (6) which holds the propulsion unit in an operative position relative to the hull. A support arrangement (7, 8; 11, 12, 13) supports the propulsion unit at a position below its operative position when the attachment mechanism is released.

14 Claims, 2 Drawing Sheets

PROPULSION UNIT

BACKGROUND OF THE INVENTION

This invention relates to a ship propulsion unit comprising a propeller pod and a turnable shaft which is attached to the propeller pod and is journalled in the hull of the ship.

Propulsion units of this kind, which are known for example from Patent Publications CA 1,311,657 and U.S. Pat. No. 5,403,216, have parts subject to wear. Such parts are for example the rotation bearing by which the turnable shaft of the propulsion unit is journalled in the ship's hull, the rotation mechanism for turning the turnable shaft, and the sealing system protecting these. When the propulsion unit is installed in a ship, there is practically no access to these parts for maintenance, such as replacement or repair of worn parts, whereby the ship has to be docked or the propulsion unit removed from the ship for carrying out the necessary maintenance activities. Maintenance of such a propulsion unit is therefore time-consuming and may give rise to considerable costs.

The object of this invention is to provide a propulsion unit by which the above mentioned disadvantages are avoided and which provides for carrying out the necessary maintenance activities in a reliable manner and with simple means.

SUMMARY OF THE INVENTION

The invention is based on the idea of providing a temporarily usable support for the propulsion unit. The support makes it possible to obtain access to parts needing maintenance without disassembly of the propulsion unit installation. This is simply arranged so that the propulsion unit may be lowered in a vertical direction to such an extent that the parts subject to maintenance are released from their operating position. Thus, the necessary maintenance measures may be carried out from the inside of the ship without docking the ship or removing the propulsion unit. Furthermore, in the case of a new building, the support makes it possible to install parts of the propulsion unit and launch the ship and complete installation, with the upper structures of the propulsion unit, after launching of the ship.

The support arrangement can be implemented by cooperating means arranged on the turnable shaft or the propeller pod and the hull of the ship respectively. The cooperating means may comprise fastening means, for example fastening elements, such as links, hooks or the like, arranged on the turnable shaft or the propeller pod and the hull of the ship, and suspension means, for example wires or the like, interconnecting the fastening elements. In this case it is not necessary to arrange any supplementary structures in the installation gap between the propulsion unit and the hull of the ship.

Another advantageous solution is that the support arrangement comprises cooperating means arranged on the turnable shaft and the hull of the ship, in the gap between the turnable shaft and the hull of the ship. The cooperating means may be constituted by at least a first member attached to the turnable shaft and at least a second member attached to the hull of the ship. The first member may be a support ring and the second member may be a pin. The advantage with this solution is that the support arrangement is always ready in place for use.

For eliminating harmful effects and preventing possible unintentional engagement of the support ring or other first member and the pin or other second member, which may occur for example when the propulsion unit swings or moves in the gap between the propulsion unit and the hull of the ship, the second member is provided with a sliding means. The sliding means may be a rotating sleeve or the like in the event that the second member is a pin.

The second member is preferably movable so that in a first position it projects into the gap for receiving the first member and in a second position is retracted from the gap. Alternatively, the second member may be removable, whereby it is completely removed from its operative position. If the second member is fitted in an opening in the hull of the ship or the turnable shaft of the propulsion unit when in its operative position, the opening can be closed when necessary with a plug for normal operation of the propulsion unit.

The support arrangement is preferably arranged above the construction water line of the ship. Consequently, when the ship is at rest, the propulsion unit can be lowered and the sealing system opened without having water flood into the ship. Against the possibility of the water level rising above the support arrangement, for example due to loading of the ship or heavy seas, it is desirable that the propulsion unit be provided with a secondary sealing system which is designed for permanently or temporarily closing the gap from below.

BRIEF DESCRIPTION OF THE DRAWINGS

The invention is described more in detail below by way of example with reference to the attached schematic drawings in which.

DETAILED DESCRIPTION

Figure 1:
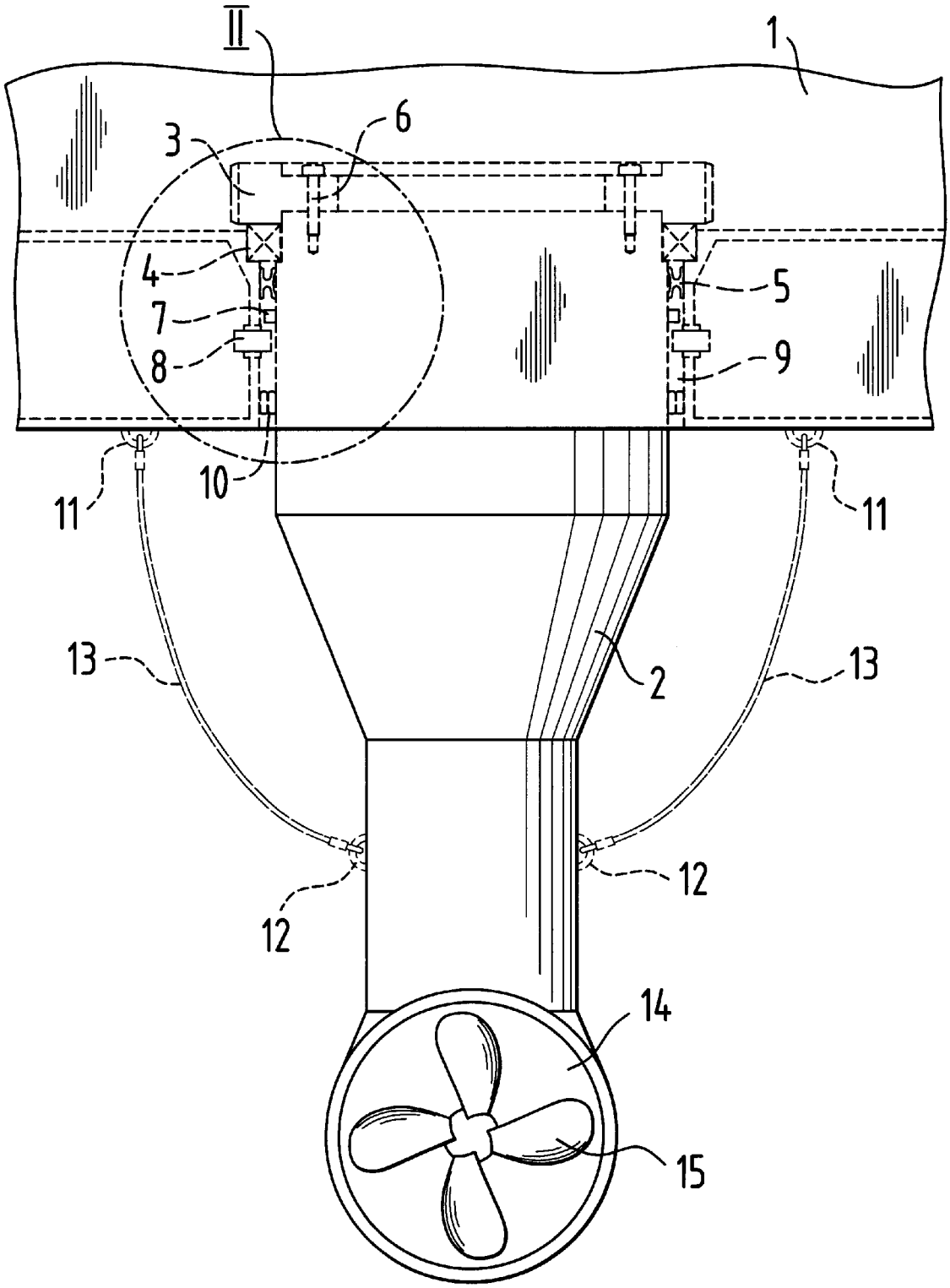
FIG. 1 is a partial sectional view of the hull of a ship provided with a propulsion unit in accordance with the present invention.
Figure 2:
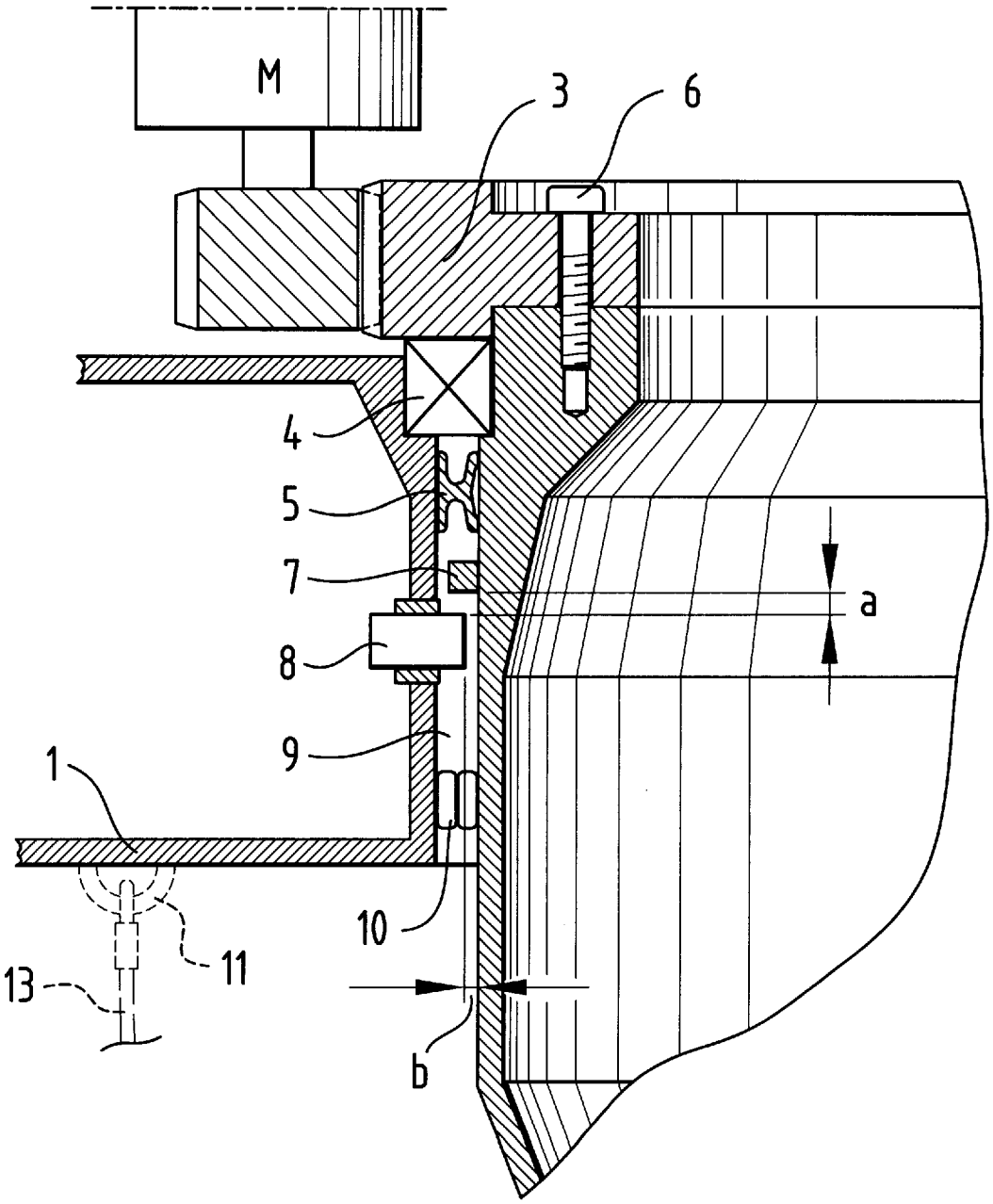
FIG. 2 is an enlarged view of the detail II of FIG. 1.

In the figures the hull of a ship is indicated by reference number 1. The hull 1 of the ship includes a cylindrical tube which extends upward from the bottom surface of the ship and forms a passage in which the upper end of a turnable shaft 2 of a propulsion unit, including a propeller pod 14 having a screw propeller 15, is located with a space or gap 9 which allows turning movement of the shaft 2 as well as other movement, such as swinging of the propulsion unit resulting from thrust of the propeller. At the upper end of the shaft 2 there is a rotation mechanism 3, including a gear in mesh with pinions driven by respective motors for turning the shaft and a rotation bearing 4 which allows turning movement of the shaft 2 relative to the hull 1. The shaft 2 of the propulsion unit is attached to the gear by supporting bolts 6. A sealing system 5 provides a seal between the hull 1 and the shaft 2 and protects the bearing 4 and the rotation mechanism 3. When the propulsion unit is fixedly installed in the manner shown in the figures, the parts needing maintenance, such as the rotation mechanism, the rotation bearing and the sealing system, are not accessible from the inside of the ship for maintenance activities.

The propulsion unit according to the invention provides a solution for this in that the turnable shaft 2 of the propulsion unit is provided with a support member 7 and a counter structure 8 is arranged in the hull 1 of the ship. The support member 7 and the counter structure 8 form a support arrangement and are arranged in the gap 9 between the turnable shaft 2 and the hull 1 of the ship, below the sealing system 5. The support member may for instance be constituted by a support ring 7 arranged on the turnable shaft and the counter structure by pins 8 arranged in the hull of the ship. The support ring may extend completely around the shaft 2 or it may be segmented. The number of pins is chosen according to need.

The width of the gap 9 between the propulsion unit 2 and the hull 1 of the ship depends mainly on the size of the propulsion unit. When the propulsion unit is fixedly installed in the hull of the ship with the fastening bolts 6, the vertical distance a between the support ring 7 and the pins 8 below it is preferably in the range of about 2 to 20 mm depending on the size of the propulsion unit. When the fastening bolts 6 are released, the propulsion unit 2 provided with the support ring 7 may be lowered to rest on the pins 8, whereby primarily the rotation mechanism 3, the rotation bearing 4 and the sealing system 5 are released from their operating position so that those parts for example may be subject to maintenance, e.g. by removing the gear of the rotation mechanism 3, the bearing 4 and the sealing system 5. The propulsion unit may then easily be raised and it may be installed fixedly in its normal operating position by tightening the fastening bolts 6. For providing freedom of movement a gap b is provided between the pins 8 and the turnable shaft 2, which gap typically is of a size of about 2 to 20 mm depending on the size of the propulsion unit, and may in some cases be even larger.

The pins 8 may be installed in a manner allowing longitudinal movement of the pins, so that they can be retracted from their operating, i.e. supporting, position, that is from the gap between the turnable shaft and the hull of the ship, when the propulsion unit is in its operating position. Alternatively, the pins may be removable, whereby the openings they leave may be closed when necessary for example by plugs or the like.

The pins may be provided with sliding means, for example with a rotating sleeve, in order to avoid engagement of the support ring and pins on unintentional contact.

Naturally, the arrangement of components may be reversed, whereby the support ring is attached to the hull of the ship and the pins project from the turnable shaft.

When the bolts 6 are released and the propulsion unit is lowered relative to the hull, the sealing system 5 no longer provides an effective seal between the hull 1 and the shaft 2. The support arrangement is preferably arranged above the construction water line of the ship. Since the support arrangement is below the upper end of the cylindrical tube, this hinders penetration of water into the structures of the ship when the sealing system does not provide an effective seal. For achieving an additional protection, or against the possibility of the water level rising above the support arrangement, the gap 9 may be closed temporarily from below by a secondary sealing system 10. This secondary sealing system may for example be a bellows sealing device, which can be activated when the propulsion unit is lowered, whereby the water may be excluded from above the secondary sealing system. The gap may naturally also be permanently closed for example by a rotary seal.

In the figures an alternative support arrangement is shown in broken lines. This support arrangement comprises fastening links 11 attached to the hull of the ship, fastening links 12 attached to the propulsion unit, e.g. the turnable shaft 2, as shown, or the propeller pod 14, and wires or cables 13 between the fastening links 11 and 12. The length of the wire can be adjusted in a manner known per se.

The figures and thereto related description are only intended for clarifying the basic concept of the invention. The propulsion unit according to the invention may vary within the scope of the claims.

We claim:

1. A ship propulsion unit comprising:

a propeller pod provided with a propulsion propeller, a turnable shaft having a lower end attached to the propulsion pod and also having an upper end, a rotation bearing mounted in the hull of the ship and by which the turnable shaft is journalled at its upper end in the hull with an annular space between the turnable shaft and the hull, a rotation mechanism mounted in the hull of the ship and coupled to the turnable shaft at the upper end thereof for effecting turning movement of the shaft, a seal in the annular space for protecting the rotation bearing and the rotation mechanism, an attachment mechanism for releasably attaching the propulsion unit to the hull and holding the propulsion unit in an operative position, and a support arrangement effective between the propulsion unit and the hull for supporting the propulsion unit at a position below its operative position when the attachment mechanism is released.

2. A propulsion unit according to claim 1, wherein the support arrangement includes cooperating elements attached to the propulsion unit and the hull respectively.

3. A propulsion unit according to claim 2, wherein the cooperating elements comprise fastening elements attached to the propulsion unit and the hull respectively and a suspension element connected between the fastening elements.

4. A propulsion unit according to claim 3, wherein the fastening elements are attached to the turnable shaft and the hull respectively.

5. A propulsion unit according to claim 1, wherein the support arrangement comprises cooperating elements provided in the annular space on the turnable shaft and the hull respectively.

6. A propulsion unit according to claim 5, wherein the cooperating elements comprise first and second cooperating elements, attached to the turnable shaft and the hull respectively, and wherein one of the first and second cooperating elements is a support ring and the other of the first and second cooperating elements is a pin.

7. A propulsion unit according to claim 6, wherein the pin is movable.

8. A propulsion unit according to claim 6, wherein the pin is removable.

9. A propulsion unit according to claim 6, wherein the pin comprises a rod element and a sliding element for preventing direct contact between the support ring and the rod element.

10. A propulsion unit according to claim 5, wherein the cooperating elements comprise first and second cooperating elements, attached to the turnable shaft and the hull respectively, and wherein the first cooperating element is a support ring and the second cooperating element is a pin.

11. A propulsion unit according to claim 1, wherein the support arrangement is disposed above the construction water line of the ship.

12. A propulsion unit according to claim 1, comprising a second seal in the annular space and below the support arrangement.

13. A propulsion unit according to claim 12, wherein the second seal is a permanent rotary seal.

14. A propulsion unit according to claim 12, wherein the second seal is a temporary seal.

* * * * *